US005337682A

United States Patent [19]

Wiseman

[11] Patent Number: 5,337,682

[45] Date of Patent: Aug. 16, 1994

[54] TV SNACK TABLE

[76] Inventor: Russell B. Wiseman, 4650 Dulin Rd., #231, Fallbrook, Calif. 92028

[21] Appl. No.: 952,565

[22] Filed: Sep. 28, 1992

Related U.S. Application Data

[63] Continuation-in-part of Ser. No. 826,144, Jan. 27, 1992, abandoned.

[51] Int. Cl.[5] ..... A47B 57/00

[52] U.S. Cl. ..... 108/94; 108/140; 108/118

[58] Field of Search ..... 108/94, 43, 139, 93, 108/69, 63, 103; 248/425, 186

[56] References Cited

U.S. PATENT DOCUMENTS

| | | | |
|---|---|---|---|
| 1,659,572 | 2/1928 | Klemm | 108/94 X |
| 1,742,904 | 1/1930 | Follmer | 108/103 X |
| 2,293,496 | 8/1942 | Egger | 108/140 X |
| 3,538,862 | 11/1970 | Patriarca | 108/94 X |
| 4,850,286 | 7/1989 | Cline | 108/118 |

FOREIGN PATENT DOCUMENTS

| | | | |
|---|---|---|---|
| 190963 | 9/1956 | Austria | 108/140 |
| 2234647 | 1/1974 | Fed. Rep. of Germany | 108/140 |
| 3742813 | 7/1989 | Fed. Rep. of Germany | 108/140 |

*Primary Examiner*—Jose V. Chen
*Attorney, Agent, or Firm*—Loyal M. Hanson

[57] ABSTRACT

A snack table includes a lower top, a set of legs connected to the lower top for supporting the lower top above a horizontal support surface, and an upper top disposed above the lower top for providing a table top surface. A mounting component connected to the upper and lower tops rotatably mounts the upper top on the lower top in order to enable a user to rotate the upper top relative to the lower top about a generally vertical axis of rotation. The mounting component is configured to place the axis of rotation off center so that rotating the upper top 180-degrees moves it from an overlying position in which the upper top overlies the lower top to an extended position in which the upper top extends laterally beyond the lower top. A horizontally extending member connected to two legs in the set of legs is included for providing a stabilizing structure upon which the user's feet can bear for table stabilizing purposes.

11 Claims, 2 Drawing Sheets

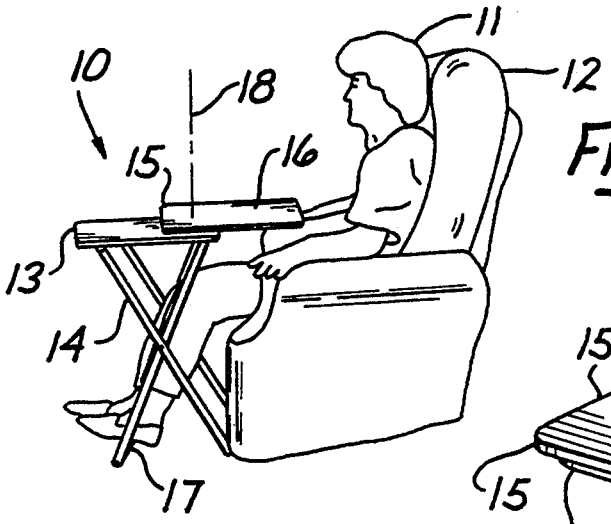
Fig. 1
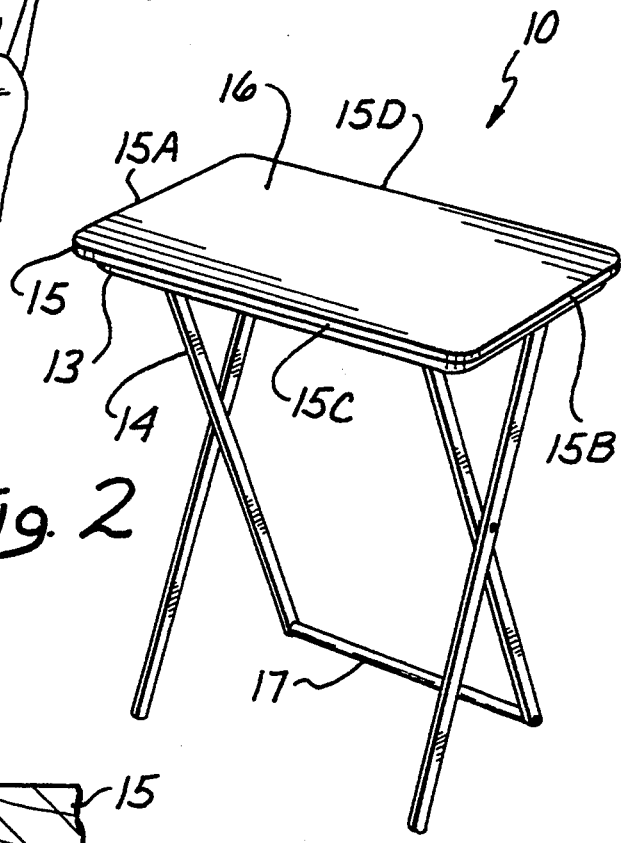
Fig. 2
Fig. 6
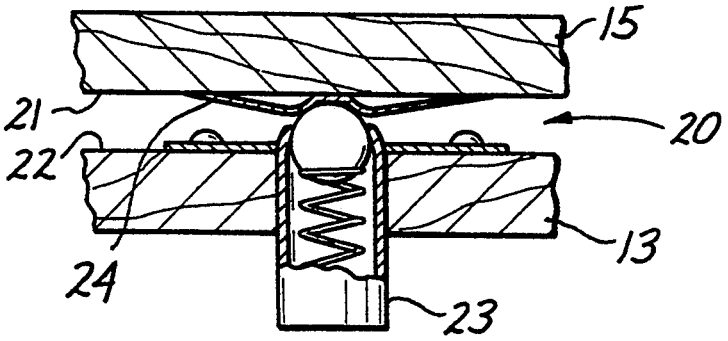
Fig. 5
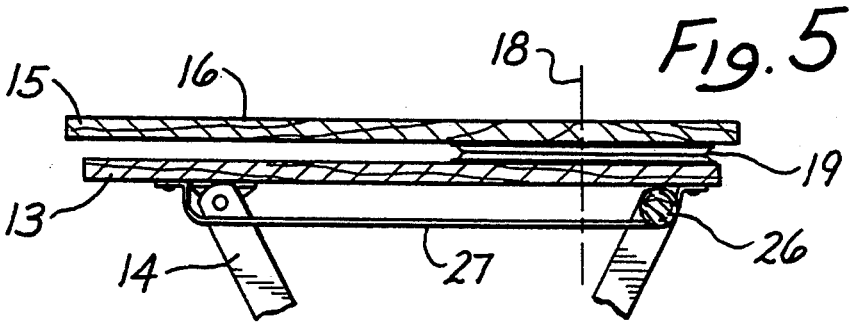

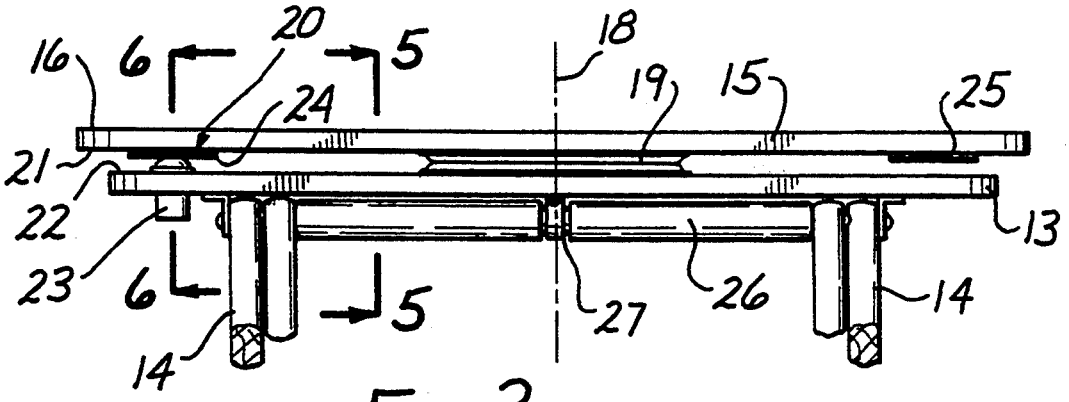
Fig. 3
Fig. 4
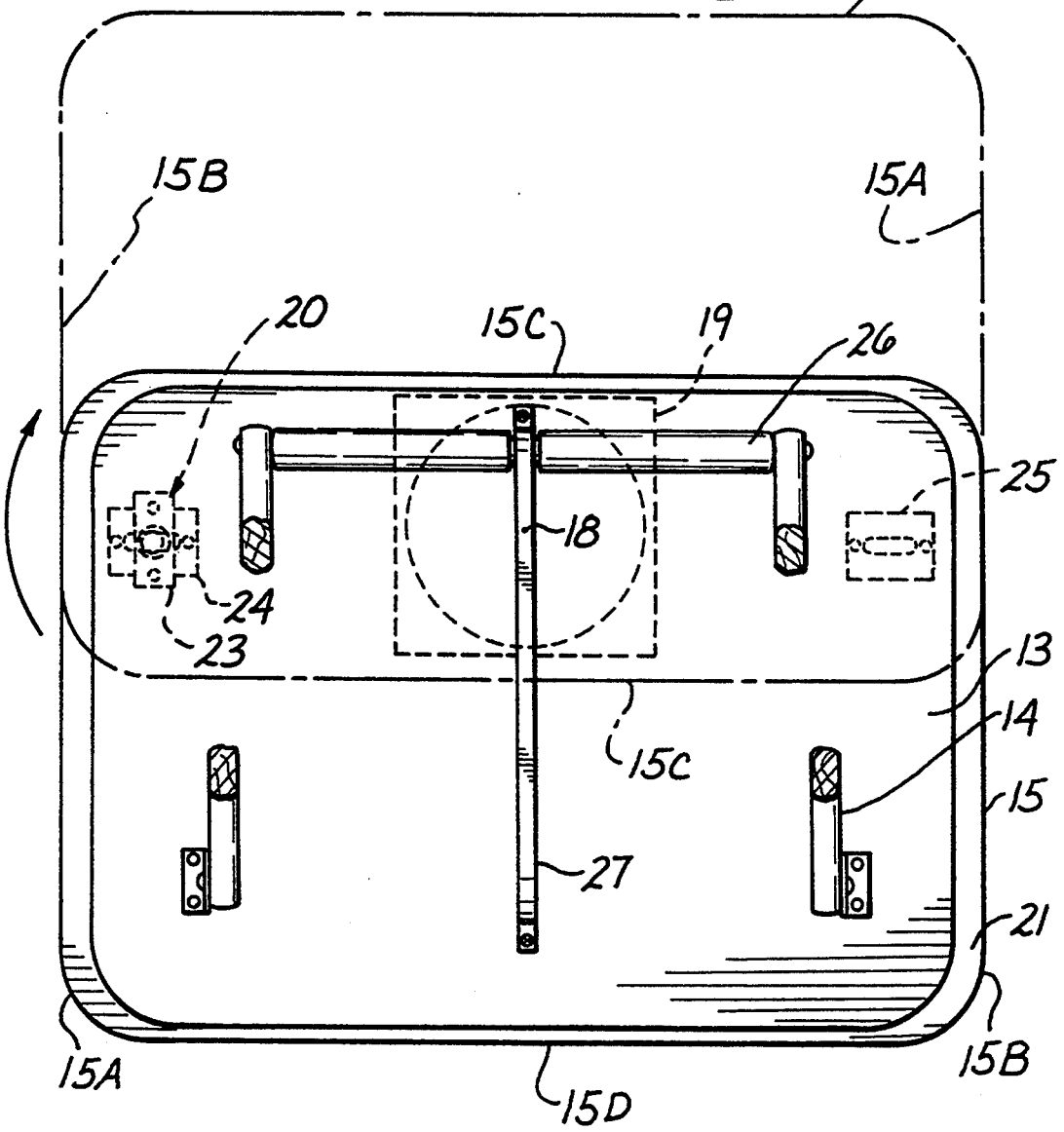

TV SNACK TABLE

CROSS REFERENCE TO RELATED APPLICATION

This application is a continuation in part of the U.S. patent application naming the same inventor that was filed Jan. 27, 1992 and assigned Ser. No. 826,144, now abandoned.

BACKGROUND OF THE INVENTION

1. Technical Field

This invention relates generally to tables, and more particularly to a television snack table for use ahead of a comfortable living room sofa or chair.

2. Background Information

The small size and light weight of a typical television snack table facilitates transport and setup. A twenty-five inch or so height mates well with conventional chairs and sofas, and a tray-size top provides enough surface area for many favorite activities. But a person reclined in a comfortable sofa or chain can find the table top difficult to reach.

Visualize a person watching television from a relaxed position in a living room sofa or chair—a position which is reclined backwardly somewhat. To reach an item on a snack table placed directly in front of them, they must assume a more erect position by moving forward in the chair or sofa or they must at least lean forward. Then they either remain poised on the edge of the seat or stretch forward each time they want to reach the table top, something that may be virtually impossible to accomplish gracefully. So, having the table top some distance ahead of the user's lap presents a problem.

Some existing tables include a movable table top. The top is mounted movably on a base so that the top can be moved closer to the user's lap. The base is made suitable large and/or heavy so that the table does not tip over toward the user.

But that arrangement does not work with the small size and light weight of a typical snack table because the footprint and size of the base is so limited. If a fully loaded top were extended horizontally toward the user, the table would tip toward the user and dump everything into the user's lap. So, a solution remains desirable—some way of making snack tables more convenient to use from a relaxed position in a sofa or chair.

SUMMARY OF THE INVENTION

This invention solves the problem outlined above by providing a television snack table with a rotatable top and a counterbalancing footrest. The rotatable top rotates off center so that it moves horizontally toward the user's lap when rotated. The counterbalancing footrest spans the legs most distant from the user so that the user's feet can hold it down and thereby keep the table from tipping.

In terms of the claim language subsequently developed, a snack table constructed according to the invention includes a lower top, a set of legs connected to the lower top, an upper top, and a rotatable mounting component connected to the upper and lower tops for rotatably mounting the upper top on the lower top. The mounting component is arranged to enable a user to rotate the upper top relative to the lower top about a generally vertical axis of rotation that is off center. Rotating the upper top 180-degrees moves the upper top from an overlying position to an extended position. Means are provided in the form of a horizontally extending member connected to two legs in the set of legs (e.g., a crossbar or rung) for providing a stabilizing structure upon which the user's feet can bear for table stabilizing purposes.

Preferably, the snack table includes a latching mechanism for securing the upper top in the overlying and extended positions. Although contemplated that the lower top may take the form of just a framework suitably arranged to support the upper top, the lower top is preferably configured much like the tops of existing snack tables. Also, the legs may fold just like existing designs.

With the legs folded and the upper top in the overlying position, the snack is carried to the user's location. Next, the legs are unfolded and the snack table is placed ahead of the user's chair or sofa. The user steadies the table by placing feet upon the crossbar. Then, the user rotates the upper top 180-degrees to the extended position where it latches in place. Snack table use then proceeds from a more relaxed position. When finished, the user simply rotates the upper top back to the overlying position (where it also latches in place) and that readies the snack table for removal.

The foregoing and other objects, features, and advantages of the invention become more apparent upon reading the following detailed description with reference to the illustrative drawings.

BRIEF DESCRIPTION OF THE DRAWINGS

FIG. 1 of the drawings is a pictorial view of a television snack table constructed according to the invention that is shown ahead of a user's chair with the upper top in the extended position;

FIG. 2 is an enlarged pictorial view of just the snack table;

FIG. 3 is an elevation view of the upper portion of the snack table showing the upper and lower tops;

FIG. 4 is an enlarged plan view of the underside of the upper and lower tops showing the extended position of the upper top in phantom lines;

FIG. 5 is a cross sectional view of the upper portion of the snack table taken on line 5—5 of FIG. 4; and FIG.6 is an enlarged cross sectional view of the latching mechanism taken on line 6—6 of FIG. 4.

DESCRIPTION OF THE PREFERRED EMBODIMENTS

The drawings show a television snack table 10 constructed according to the invention. FIG. 1 shows it set up ahead of a user 11 seated well back in a comfortable living room chair 12. The table 10 includes a first or lower top 13 on a set of legs 14, and a second or upper top 15 that provides a horizontal support surface (i.e., a table top 16). The lower top 13 and the set of legs 14 may be similar in many respects to the top and legs of existing snack tables. The major difference resides in the additional rotatable top (i.e., the upper top 15) and a crossbar 17.

With feet upon the crossbar 17, the user 11 rotates the upper top 15 180-degrees relative to the lower top 13 about a vertical rotational axis 18 to an extended position (the position illustrated in FIG. 1). In the extended position, the upper top 15 extends further toward the upper body of the user 11 than does the lower top 13. That makes the table 10 more convenient to use. The user 13 need not lean forward or perch on the edge of the chair. Bearing downwardly on the crossbar 17 counterbalances the extended upper top 13.

When finished with the table 10, the user 11 rotates the upper top 15 180-degrees back to an overlying position. FIG. 2 illustrates the overlying position. In that position, the upper top 15 overlies the lower top 13. The set of legs 14 may then be folded relative to the lower top 13 in a conventional manner to carry the table 10 away for storage. Of course, the legs need not be foldable within the inventive concepts disclosed. Moreover, the lower top need not be a top in the conventional sense that it includes an upwardly facing surface. It could be any suitable support structure for the upper top, rotatable mounting component, and latching mechanism subsequently described.

Nevertheless, the table 10 and various other embodiments of the invention may be said to be an improved snack table of the type having a conventional top (the lower top 13) mounted on a set of legs. The improvement comprises a second, rotatable top (the upper top 15) mounted on the lower top 13 for rotation between the overlying and extended positions described, and a crossbar 17 for counterbalancing purposes. As for the conventional aspects, they may follow the designs of the snack tables available from R. R. Scheibe Co. of Brockton, Mass. The table 10 may be fabricated from any of various suitable materials, such as wood. It may have a rectangular, oval, or other suitably shaped, tray-size top and stand about twenty-five inches high upon foldable legs.

The inventive upper top 15 may also be made of wood. Preferably, it is shaped and dimensioned similar to, but just a little larger than, the lower top 13. That way, the upper top 15 overhangs the lower top 13 slightly for aesthetic reasons. A mounting component 19 (FIGS. 3–5) rotatably mounts the upper top 15 on the lower top 13, and a latching mechanism 20 (FIGS. 3, 4, and 6) disposed between an underside 21 of the upper top 15 and an upperside 22 of the lower top 13 latches the upper top 15 in the overlying and extended positions.

The mounting component 19 is connected rigidly to the upper top 15 and lower top 13 by suitable means such as screws. It serves the function of preventing linear motion of the upper top 15 relative to the lower 13 top while still enabling rotational movement in order to enable the user 11 to rotate the upper top 15 relative to the lower top 13 about the axis of rotation 18. The mounting component 19 may take any suitable form for that purpose, such as the commercially available ball bearing mounting components used for rotatable serving trays, rotatable television stands, and so forth.

According to the invention, the mounting component 19 is configured so that the rotational axis 18 is located off center. In other words, it is connected to the upper and lower tops in a position such that the rotational axis 18 is disposed generally midway between a left edge 15A and right edge 15B of the upper top 15 (FIGS. 2 and 4), but closer to a proximal edge 15C than a distal edge 15D. As a result, the distal edge 15 rotates toward the user 11 when the upper top 15 is rotated to the extended position. In that connection, the terms proximal and distal describe the position of the edges relative to the user when the upper top is in the overlying position.

As for the latching mechanism 20, it is also connected to the upper and lower tops. It serves the function of latching the upper top 15 in the overlying and extended positions. It may take any suitable form within the inventive concepts disclosed. The illustrated latching mechanism 20 includes a spring-loaded ball component 23 that engages a first striker plate 24 (FIGS. 3, 4, and 6) in the overlying position and a second striker plate 25 (FIGS. 3 and 4) in the extended position. The user 11 just rotates the upper top 15 to the desired position and the spring-loaded ball component 23 snaps into engagement with the striker plates.

Concerning the crossbar 17, it serves the function of providing a stabilizing structure upon which the user's feet can bear for table stabilizing purposes. Bearing downwardly on the crossbar 17 counterbalances the weight of objects placed on the upper table top 15. For that purpose, the stabilizing structure may take any of various suitable forms. The crossbar 17 is chosen for the illustrated table 10 to compliment an upper crossbar 26 (FIGS. 3–5) that slides along a retainer 27 when the set of legs 14 are folded. Preferably, the crossbar 17 extends between far legs 28 and 29 (FIG. 2) just above floor level.

Thus, the invention provides a snack table with a rotatable double top. The lower top is fixed on legs as usual and the upper top is mounted rotatably and off center on the lower one. Rotating the upper top 180-degrees moves it closer to the user's lap. The user need not move forward or stretch significantly to reach the table, and so snack table use can proceed from a more relaxed position. The rung enables the snack table to remain small size and light weight without an exagerated footprint.

In addition, notice that the table 10 works well for writing while seated comfortably in the chair 12. With the upper top 15 in the extended position, the user 11 keeps feet off the crossbar 17 and tilts the table 10 on the near legs toward the chair so that the edge 15D moves downwardly toward the user's lap. The surface 16 of the upper top 15 then occupies an inclined position where it serves as a convenient writing surface.

Although an exemplary embodiment has been shown and described, many changes, modifications, and substitutions may be made by one having ordinary skill in the art without necessarily departing from the spirit and scope of the invention. In that connection, notice that the specification and claims make reference to upper, lower, above, atop, beneath, ahead, horizontal, vertical and so forth. Those positional terms are used to facilitate description. They suppose, of course, that the snack table is unfolded and otherwise set up and standing in a functional position upon a floor or other horizontal support surface.

What is claimed is:

1. A snack table, comprising:

a lower top;

means in the form of a set of legs connected to the lower top for supporting the lower top above a horizontal support surface;

means in the form of an upper top disposed above the lower top for providing a table top surface;

said upper top including oppositely disposed left and right edges and oppositely disposed proximal and distal edges;

means in the form of a rotatable mounting component connected to the upper and lower tops for rotatably mounting the upper top on the lower top in order to enable a user to rotate the upper top relative to the lower top about a generally vertical axis of rotation that is off center so that rotating the upper top 180-degrees moves the upper top from an overlying position in which the upper top overlies the lower top to an extended position in which the upper top extends horizontally beyond the lower top, the mounting component being rigidly connected to the upper and lower tops in order to prevent linear movement of the upper top relative to the lower top while still enabling rotational movement about the axis of rotation;

said mounting component is configured so that the rotational axis is located generally midway between the left and right edges and closer to the proximal edge than the distal edges;

means in the form of a horizontally extending member connected to two legs in the set of legs for providing a stabilizing structure upon which the user's feet can bear for table stabilizing purposes.

2. A snack table as recited in claim 1, further comprising means in the form of a latching mechanism connected to the upper top and the lower top for latching the upper top in at least one of the overlying position and the extended position.

3. A snack table as recited in claim 1, wherein the means for providing a stabilizing structure includes a rung extending between the two legs.

4. A snack table as recited in claim 1, wherein the lower top takes the form of a tray-size member.

5. A snack table as recited in claim 1, wherein the upper top and the lower top have a common size and shape.

6. A snack table as recited in claim 1, wherein the set of legs are foldably connected to the lower top.

7. An improved snack table of the type having a first top mounted on a set of legs, the improvement comprising:

a second top disposed above the first top in an overlying position in which the second top overlies the first top;

said second top includes oppositely disposed left and right edges and oppositely disposed proximal and distal edges;

means in the form of a rotatable mounting component connected to the first and second tops for rotatably mounting the second top on the first top in order to enable the user to rotate the second top relative to the first top about a generally vertical axis of rotation that is off center so that rotation the secont tip 180-degress moves the second top from an overlying position in which the second top overlies the first top to an extended position in which the second top extends horizontally beyond the first top, the mounting component being rididly connected to the upper and lower tops in order to prevent linear movement of the upper top relative to the lower top while still enabling rotation movement about the axis of rotation;

the mounting component is configured so that the rotational axis is located generally midway between the left and right edges and closer to the proximal edge than the distal edges;

means in the form of a horizontally extending member connected to two legs in the set of legs for providing a stabilizing structure upon which the user's feet can bear for table stablizing purposes.

8. A snack table as recited in claim 7, further comprising means in the form of a latching mechanism connected to the upper top and the lower top for latching the upper top in at least one of the overlying position and the extended position.

9. A snack table as recited in claim 7, wherein the means for providing a stabilizing structure includes a rung extending between the two legs.

10. A snack table as recited in claim 7, wherein the lower top takes the form of a tray-size member.

11. A snack table as recited in claim 7, wherein the upper top and the lower top have a common size and shape.

* * * * *